US005901713A

United States Patent [19]

Mroczek

[11] Patent Number: 5,901,713

[45] Date of Patent: May 11, 1999

[54] PONY-TAIL HOLDER

[76] Inventor: John S. Mroczek, 1916 Linden Ave., Mishawaka, Ind. 46544

[21] Appl. No.: 08/828,752

[22] Filed: Mar. 21, 1997

Related U.S. Application Data

[60] Provisional application No. 60/015,220, Apr. 10, 1996.

[51] Int. Cl.[6] ..... A45D 8/36; A45D 8/00

[52] U.S. Cl. ..... 132/273; 132/275

[58] Field of Search ..... 132/273, 276, 132/278

[56] References Cited

U.S. PATENT DOCUMENTS

| | | | |
|---|---|---|---|
| D. 90,188 | 6/1933 | Behr | 132/273 |
| 248,542 | 10/1881 | Wilson | 132/275 |
| 565,884 | 8/1896 | Emmons | 132/275 |
| 2,488,954 | 11/1949 | Winters | 132/275 |
| 3,751,769 | 8/1973 | Reiner | 132/273 |
| 3,842,849 | 10/1974 | Goodman | 132/273 |
| 5,293,884 | 3/1994 | Chapman et al. | 132/273 |
| 5,365,954 | 11/1994 | Rude | 132/273 |
| 5,535,765 | 7/1996 | Takashima | 132/273 |

*Primary Examiner*—Paul J. Hirsch
*Attorney, Agent, or Firm*—Baker & Daniels

[57] ABSTRACT

A pony-tail holder which includes a slotted cylindrical body member having a loop attachment connected to its inner surface opposite the slot formed in the body member. A circular elastic cord is loop knotted over the loop attachment and serves to elastically retain in an enclosing manner the pony-tail of the wearer which is housed within the body member of the holder.

10 Claims, 1 Drawing Sheet

FIG. 1
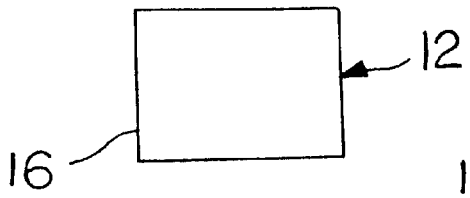
FIG. 2
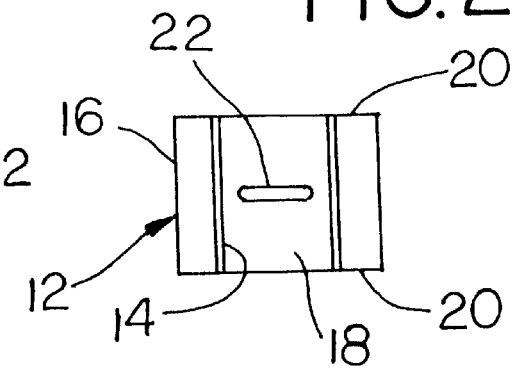
FIG. 6
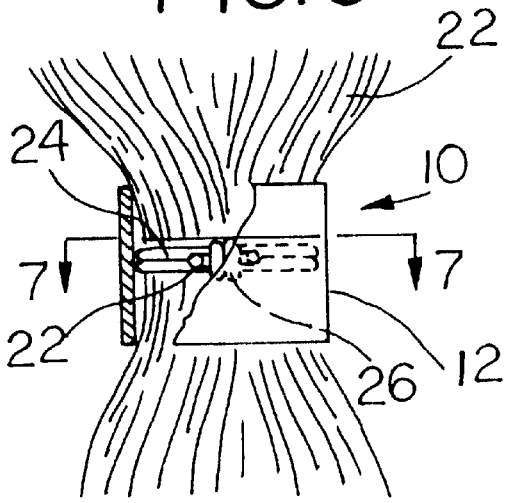
FIG. 3
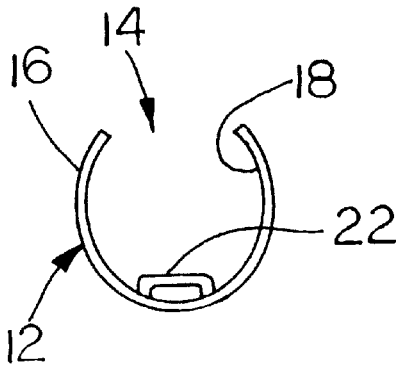
FIG. 4
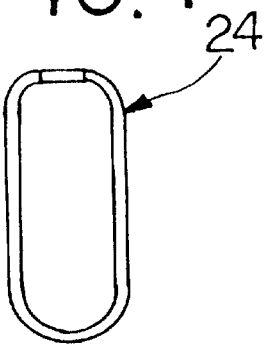
FIG. 5
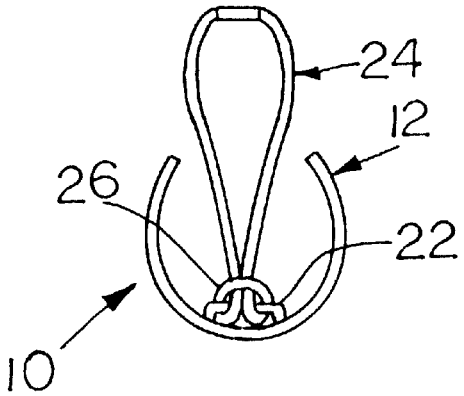
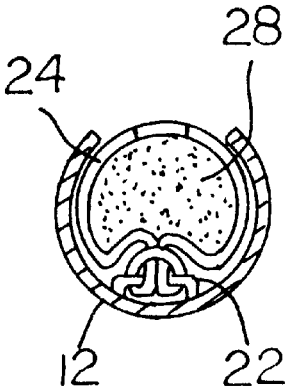
FIG. 7

PONY-TAIL HOLDER

This application claims the benefit of U.S. Provisional Application No. 60/015,220, filed Apr. 10,1996.

SUMMARY OF THE INVENTION

This invention relates to a hair device that has particular application to a holder for pony-tails.

This invention includes a body member having a cylindrical shape with a slotted opening. Inside the body member, opposite the slotted opening, is a fixed loop part. Attached to the loop part is an elastic circular cord. The elastic cord encircles the pony-tail which cradles the pony-tail within the body member.

It is an other object of this invention to provide a holder for hair, namely, a pony-tail.

It is another object of this invention to provide a pony-tail holder which substantially cups the hair and is held in position relative to the length of hair.

Other objects of this invention will become apparent upon a reading of the following description.

BRIEF DESCRIPTION OF THE DRAWINGS

FIG. 1 is a front view of the body member of the holder of this invention.

FIG. 2 is a rear view of the body holder of this invention, having the elastic hair retaining cord removed.

FIG. 3 is a top view of FIG. 2.

FIG. 4 is a planar view of the elastic cord.

FIG. 5 is a top view like FIG. 3 but showing the elastic cord of FIG. 4 looped and connected to the body member.

FIG. 6 is a view of the body member secured about a pony-tail and having portions broken away for purposes of illustrating the cord placement about the hair and its connection to the body member.

FIG. 7 is a cross sectional view as seen from line 7—7 of FIG. 6.

DESCRIPTION OF THE PREFERRED EMBODIMENT

The preferred embodiment herein described is not intended to be exhaustive or to limit the invention of the precise form disclosed. It is chosen to describe to explain the principles of the invention and its application and practical use to enable others skilled in the art to use the invention.

The pony-tail holder 10 of this invention includes a body member or cuff 12. Body member 12 is of partial cylindrical form having at its rear a slot 14. While body holder 12 is illustrated as having straight side walls, it still would be within the scope of this invention to produce the body holder with slightly bowed or barrel-shaped side walls.

Body member 12 includes a outer surface 16 and an inner surface 18. Fixedly connected to the inner surface 18 of body member 12 and preferably centered equal distance from the upper and lower edges 20 of the body holder is a fastener or loop part 22. A circular elastic cord 24 is loop knotted at 26 about loop part 22 so as to be firmly attached to body member 12 as illustrated in FIG. 5. Cord 24 serves as a constrictive means surrounding the pony-tail 28 of the wearer as illustrated in FIG. 6.

To apply, the pony-tail is fitted through cord 24 and fitted into the center of body member 12 through opening 14 with the body member cupping the hair. Due to the extent of the annular length of body member 12, the body member will nearly fully cup the hair of the user and cover from exterior view the hair encircling cord 24 (see FIGS. 6 and 7).

Cord 24, which is shown in FIG. 6 as double looped, serves to constrictively grip the pony-tail to prevent rotative or longitudinal movement of the body member relative to the pony-tail. By utilizing loop part 22 which forms a permanent component of body member 12, the elastic cord 24 is permanently fastened by being loop knotted or otherwise connected to the body member.

Body member 12 can be formed of a variety of materials such as plastic, metal, wood or ceramics.

What is claimed is:

1. A holder for hair formed into a pony tail comprising:

a body member for attachment to the pony tail including a curved partly circular wall having an inner surface, said curved wall defining an interior space bounded by said inner surface and having a slot in communication with an interior surface, and a retainer integral to said curved wall and being generally oppositely spaced from said slot; and a circular resilient cord for encircling the pony tail attached to said retainer;

said body member constituting means for encircling said pony tail except at said slot when said cord constrictively encircles the pony tail.

2. A device according to claim 1 wherein said retainer extends from said inner surface into said interior space.

3. A device according to claim 1 wherein said curved wall has a C-shaped cross-section.

4. A device according to claim 1 wherein said curved wall has upper and lower edges, said retainer being substantially centered between said upper and lower edges.

5. A device according to claim 4 wherein said upper edge is parallel to said lower edge.

6. A device according to claim 2 wherein said retainer is an elongated member connected at both ends to said inner surface, said cord being attached to said elongated member with a portion said cord located between said elongated member and said inner surface.

7. A device according to claim 6 wherein said curved wall further includes upper and lower edges, said elongated member substantially centered between said edges.

8. A device according to claim 1 wherein said inner surface is substantially cylindrical.

9. A device according to claim 1 wherein said inner surface is one of either straight-sided or outwardly bowed shape.

10. A holder for hair formed into a pony tail comprising:

a body member for attachment to the pony tail including a curved partly circular rigid wall having an inner surface, said curved wall defining an interior spaced bounded by said inner surface and having a slot in communication with an interior surface, and a retainer integral to said curved wall and being oppositely spaced from said slot;

said body member constituting means for encircling said pony tail except at said slot; and a circular resilient cord attached to said retainer for constrictively encircling said pony tail to secure and support said body member about said pony tail.

* * * * *